United States Patent [19]

Mueller

[11] 3,998,070

[45] Dec. 21, 1976

[54] SYRUP COOLING SYSTEM FOR COLD DRINK MACHINE

[75] Inventor: Richard J. Mueller, Mountain Lakes, N.J.

[73] Assignee: Rowe International, Inc., Whippany, N.J.

[22] Filed: May 28, 1975

[21] Appl. No.: 581,559

[52] U.S. Cl. ..... 62/393; 62/394; 62/396; 62/434; 62/435

[51] Int. Cl.[2] ..... B67D 5/62

[58] Field of Search ..... 62/373, 375, 376, 389, 62/393–396, 430–436

[56] References Cited

UNITED STATES PATENTS

| | | | |
|---|---|---|---|
| 1,703,351 | 2/1929 | Molesworth et al. | 62/433 |
| 1,891,305 | 12/1932 | Fosberry | 62/431 |
| 2,067,431 | 1/1937 | Albertson | 62/433 |
| 2,144,985 | 1/1939 | Markley, Jr. | 62/376 |
| 2,259,852 | 10/1941 | Hall | 62/376 |
| 2,618,938 | 11/1952 | Booth et al. | 62/436 |
| 3,721,105 | 3/1973 | Schwertfoger | 62/396 X |

*Primary Examiner*—William E. Wayner
*Assistant Examiner*—Ronald C. Capossela
*Attorney, Agent, or Firm*—Shenier & O'Connor

[57] ABSTRACT

Syrup tanks in a beverage dispenser having a cold water bath are cooled by circulating water from the water bath through a coil disposed adjacent to the syrup tanks in heat exchange relationship therewith. In the preferred embodiment, the coil is located between adjacent rows of syrup tanks to maximize heat transfer.

8 Claims, 2 Drawing Figures

SYRUP COOLING SYSTEM FOR COLD DRINK MACHINE

BACKGROUND OF THE INVENTION

This invention relates to a cooling system for the syrup tanks of an automatic carbonated beverage dispenser.

Beverage dispensers of the type having a cold water bath which is used to cool various components of the dispenser, such as the carbonator and still water supply line, are known in the art. An example of such an arrangement is shown in U.S. Pat. No. 2,536,400, issued Jan. 2, 1951 to E. H. Thompson. By pre-chilling beverage constituents, such as carbonated water, such arrangements allow a large number of beverages to be dispensed over a short period of time while maintaining their temperature at a low level. For the same reasons, it is desirable also to pre-chill the syrup supplies mixed with the carbonated water to form the various carbonated beverages. Arrangements such as the Thompson apparatus, supra, which accomplish this objective by placing the syrup tank itself in the water bath make the syrup tank less accessible for servicing. Other arrangements which chill only the outlet line running from the syrup tank rather than the tank itself fail to provide the peak period capability provided by true pre-chilling.

SUMMARY OF THE INVENTION

One object of our invention is to provide a cooling system for the syrup tanks of an automatic carbonated beverage dispenser, which effectively pre-chills the syrup tanks.

A second object of our invention is to provide a cooling system which leaves the syrup tanks available for servicing.

Other and further objects of this invention will appear from the following description:

In accordance with the present invention, syrup tanks in a beverage dispenser having a cold water bath are cooled by circulating water from the water bath through heat exchange coil disposed adjacent to the syrup tanks in heat exchange relationship therewith. Preferably, the coil is located between adjacent rows of syrup tanks to maximize heat transfer and to leave the syrup tanks accessible from above. It will be seen that this system accomplishes the above stated objects of pre-chilling the entire syrup supply, yet leaving the syrup tanks accessible for servicing.

DETAILED DESCRIPTION OF THE INVENTION

Figure 1:
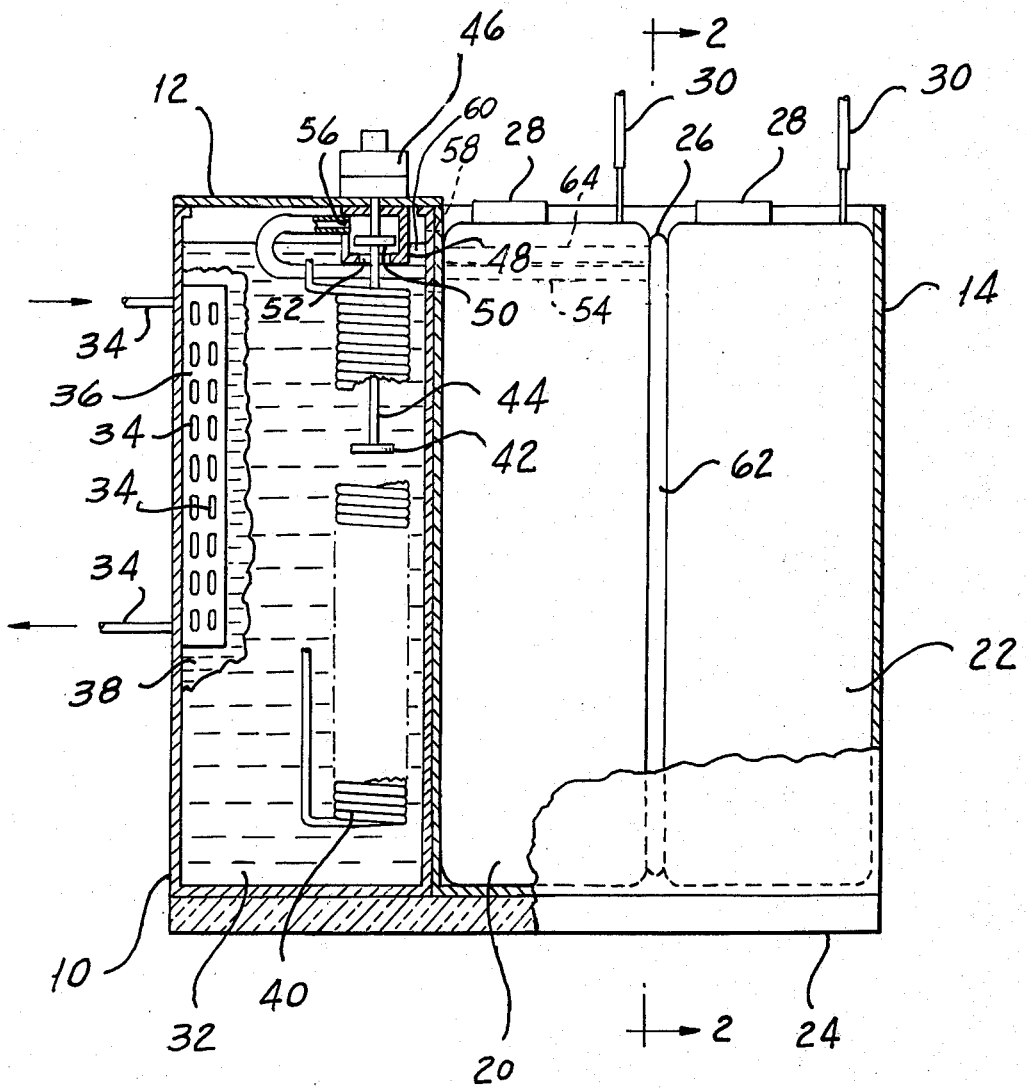
FIG. 1 is an elevation of one embodiment of the cooling system and associated components of the beverage dispenser, some parts being shown in sections.
Figure 2:
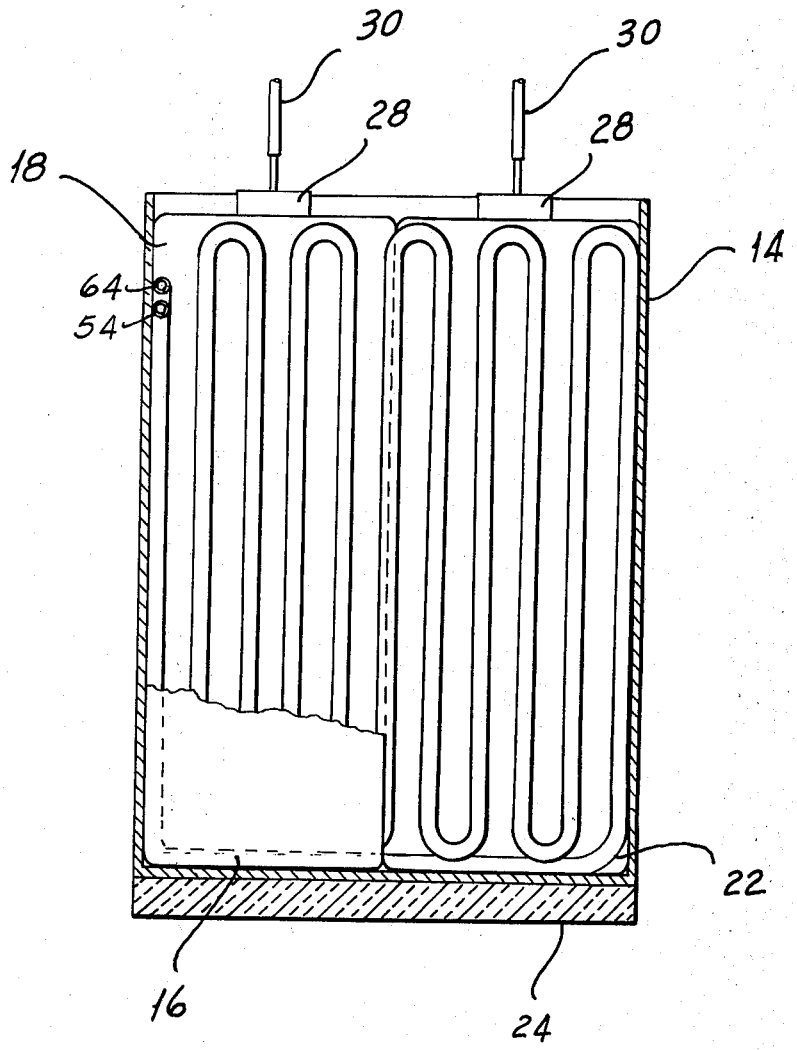
FIG. 2 is a sectional view of the embodiment shown in FIG. 1 taken along line 2—2 of the FIG. 1.

Referring now to the drawings, water bath tank 10 having a tank cover 12 and a syrup tank compartment 14 containing four five gallon syrup tanks 16, 18, 20 and 22. The water tank 10 and syrup tank compartment 14 are supported by a heat insulative support surface 24 in the cold drink vendor cabinet (not shown). Syrup tanks 16 to 22 are arranged side by side relationship with a gap 26 between a row containing tanks 16 and 20 and a row containing tanks 18 and 22. Each of the tanks 16 to 22 is provided with a filling cap

28 and with a delivery tube 30 for drawing syrup from the tank. The water bath tank 10 is filled nearly to the top with water 32 which is cooled by means of a refrigerating coil 34 which is threaded through a pluraity of evaporator fins 36 located along one of the walls of the water tank 10 to form a block of ice 38 on the adjacent tank wall.

The water bath 32 is used to cool a number of dispenser components, including a carbonator (not shown) and a completely submerged cooling coil 40 having a length of approximately 50 feet and which chilled still water for non-carbonated beverages. An impeller 42 extending through the cooling coil 40 is coupled via a shaft 44 to a motor 46 mounted on the tank cover 12 to circulate the water 32 in the bath.

My cooling system for the syrup tanks includes a pump 48 mounted near the top of the water tank 10 and having an impeller 50 driven by the same shaft 44 as is the agitator impeller 42. Water is drawn into the pump through an inlet 52 and is pumped through an outlet 56 into one end of a line or conduit 54 formed out of copper or other heat conducting material. Line 54 leads to a coil 62 made up of a plurality of vertically extending stands connected by return bends. A return line 64 from coil 62 passes through an opening 58 in the tank wall 10 to complete the circulating system.

Because of the circulating nature of the cooling system, it is possible to use the system to filter the water in the water tank 10 to prevent undesirable sedimentation or tank surface deposits. To accomplish this objective, a filter 60 is placed on the return end of the line 64 to filter the water returning to the tank 10. Coil 62 is placed in the space 26 between the two pairs of tanks 16 and 18 and 20 and 22 in intimate heat exchange relationship therewith. Effective cooling of the syrup is exhanced by the fact that the tanks customarily are constructed from heat conducting metal and by the fact that syrup is depleted from the tank at a relatively slow rate.

In operation, actuation of the pump 48 causes water to be drawn into the fluid line 53 through the pump inlet 52 located near the top of the water bath 32. Because of the location of the pump 48 near the water line, water loss due to line breakage or other malfunction should be minimal. Water drawn into the line 54 is circulated through the coil 62 to cool the syrup tanks 16–22 and is then returned to the bath 32 through the return line 64 and the filter 60. For periodic replacement or other servicing, the syrup tanks 16–22 may readily be removed from the compartment 14 simply by lifting them upward, the fluid line 54 interfering in no way the removal operation. While, in the preferred embodiment, the syrup tanks 16 to 22 are located adjacent to the water tank 10, this particular arrangement is not necessary since the essential cooling mechanism is provided by the line 54. Also, while the arrangement of the fluid line 54 which is shown is preferable in that it maximizes heat transfer for a given length of line, the exact arrangement is not critical and other arrangements, particularly one in which more than two syrup tanks are located on either side of the coiled portion 56, may also be used.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In a cold drink dispensing machine, apparatus comprising:

a cold water bath tank;

means for chilling the water in said water bath tank;

a pair of generally rectangular syrup tanks;

a generally planar vertically oriented heat exchanger;

means for circulating water from said water bath tank through said heat exchanger and back to said water tank; and means for positioning said syrup tanks on either side of said heat exchanger in intimate contact therewith.

2. Apparatus as in claim 1 in which said heat exchanger comprises a coil having a plurality of parallel vertically extending segments.

3. Apparatus as in claim 1 in which said syrup tank positioning means comprises a rectangular support surface and retaining walls extending upwardly from said support surface.

4. Apparatus as in claim 1 further comprising an agitator in said water bath tank and a motor having a shaft for driving said agitator, said circulating means comprising a pump and means for coupling said pump to said agitator motor shaft.

5. Apparatus as in claim 1 further comprising an agitator and a motor having a generally vertically extending shaft for driving said agitator, said circulating means comprising a pump, means for mounting said pump above said water bath tank, and means for coupling said pump to said agitator.

6. Apparatus as in claim 1 in which said circulating means comprises a line having a filter at one end thereof.

7. Apparatus as in claim 1 in which said circulating means comprises a pump having an inlet and means for mounting said pump near the top of said water bath tank with said inlet extending into said water bath.

8. Apparatus as in claim 7 further including an agitator in said water bath tank, a motor having a shaft for driving said agitator, and means for coupling said shaft to said pump.

* * * * *